US012624434B2

(12) United States Patent
Ito et al.

(10) Patent No.: US 12,624,434 B2
(45) **Date of Patent: *May 12, 2026**

(54) HOT-ROLLED STEEL SHEET

(71) Applicant: NIPPON STEEL CORPORATION, Tokyo (JP)

(72) Inventors: Daisuke Ito, Tokyo (JP); Akifumi Sakakibara, Tokyo (JP); Teruki Hayashida, Tokyo (JP); Tatsuo Yokoi, Tokyo (JP); Kazuhisa Kusumi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 18/711,674

(22) PCT Filed: Dec. 22, 2022

(86) PCT No.: PCT/JP2022/047271

§ 371 (c)(1),
(2) Date: May 20, 2024

(87) PCT Pub. No.: WO2023/132254

PCT Pub. Date: Jul. 13, 2023

(65) Prior Publication Data

US 2025/0109467 A1 Apr. 3, 2025

(30) Foreign Application Priority Data

Jan. 7, 2022 (JP) ..... 2022-001416

(51) Int. Cl.

| | |
|---|---|
| ***C22C 38/58*** | (2006.01) |
| ***C21D 1/18*** | (2006.01) |
| ***C21D 6/00*** | (2006.01) |
| ***C21D 8/02*** | (2006.01) |
| ***C21D 8/0221*** | (2026.01) |
| ***C21D 8/0247*** | (2026.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/28*** | (2006.01) |
| ***C22C 38/38*** | (2006.01) |
| ***C22C 38/42*** | (2006.01) |
| ***C22C 38/50*** | (2006.01) |
| ***C22C 38/54*** | (2006.01) |

(52) U.S. Cl.

CPC ..... *C22C 38/58* (2013.01); *C21D 1/18* (2013.01); *C21D 6/002* (2013.01); *C21D 6/004* (2013.01); *C21D 6/005* (2013.01); *C21D 6/008* (2013.01); *C21D 8/0205* (2013.01); *C21D 8/0226* (2013.01); *C21D 8/0263* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/28* (2013.01); *C22C 38/38* (2013.01); *C22C 38/42* (2013.01); *C22C 38/50* (2013.01); *C22C 38/54* (2013.01); *C21D 2211/002* (2013.01); *C21D 2211/005* (2013.01); *C21D 2211/008* (2013.01); *C21D 2211/009* (2013.01)

(58) Field of Classification Search

CPC ..... C22C 38/58; C21D 2211/008

See application file for complete search history.

(56) References Cited

FOREIGN PATENT DOCUMENTS

| | | |
|---|---|---|
| JP | 2016-211073 A | 12/2016 |
| JP | 2018-188675 A | 11/2018 |

*Primary Examiner* — Alexandra M Moore

(74) *Attorney, Agent, or Firm* — Birch, Stewart, Kolasch & Birch, LLP

(57) ABSTRACT

A hot-rolled steel sheet has a predetermined chemical composition, a microstructure at a location of ¼ of a sheet thickness and at a location of 100 μm from a surface comprising, in area %, one or more of martensite and tempered martensite: 95% or more in total, and ferrite, bainite and pearlite: 5% or less in total, and an average dislocation density at the location of 100 μm from the surface is 1.2 times or more of an average dislocation density at the location of ¼ of the sheet thickness.

7 Claims, No Drawings

HOT-ROLLED STEEL SHEET

TECHNICAL FIELD

The present invention relates to a hot-rolled steel sheet.

Priority is claimed on Japanese Patent Application No. 2022-1416, filed Jan. 7, 2022, the content of which is incorporated herein by reference.

BACKGROUND ART

In recent years, the strength of steel sheets has been increasing to ensure the collision safety of automobiles and reduce the environmental load. In order to increase the strength of steel sheets, making microstructures have a martensite single phase is effective. Steel sheets in which microstructures have a martensite single phase have poor fatigue limit compared to composite structure steel sheets such as dual phase (DP) steel sheets and transformation induced plasticity (TRIP) steel sheets.

For example, Patent Document 1 discloses a high-strength hot-rolled steel sheet which has a martensite phase or tempered martensite phase as a main phase, has a structure in which a volume ratio of the main phase with respect to the entire structure is 90% or more, an average grain size of prior austenite grains is 20 μm or less in a cross section parallel to a rolling direction and 15 μm or less in a cross section perpendicular to the rolling direction, and an aspect ratio of the prior austenite grains in the cross section parallel to the rolling direction is 18 or less, and has excellent low temperature toughness.

Patent Document 2 discloses a high-strength hot-rolled steel sheet in which a steel structure is composed of at least one of a martensite phase and a tempered martensite phase, which has a main phase in which an area ratio with respect to the entire steel structure is 95% or more, which contains cementite with an average grain size of 0.5 μm or less in a lath of the martensite phase and/or the tempered martensite phase, and in which the content of cementite is, in % by mass, 0.01 to 0.08%.

CITATION LIST

Patent Document

Patent Document 1: Japanese Unexamined Patent Application, First Publication No. 2016-211073

Patent Document 2: Japanese Unexamined Patent Application, First Publication No. 2018-188675

SUMMARY OF INVENTION

Technical Problem

The present inventors have found that the steel sheets described in Patent Documents 1 and 2 do not provide sufficient bendability and fatigue limit.

An object of the present invention which has been made in view of the above circumstances is to provide a hot-rolled steel sheet having high strength and fatigue limit, and excellent bendability.

Means for Solving the Problem

The present inventors obtained the following findings as results of creative research and conceived the present invention.

It was found that a hot-rolled steel sheet having high strength and fatigue limit, and excellent bendability can be obtained by setting martensite and tempered martensite are a main phase in a microstructure at a location of ¼ of a sheet thickness and at a location of 100 μm from a surface, and setting an average dislocation density at the location of 100 μm from the surface to 1.2 times or more of an average dislocation density at the location of ¼ of the sheet thickness.

Also, the present inventors have found that strictly controlling chemical composition, finish rolling conditions and cooling conditions after finish rolling are particularly effective in order to obtaining the hot-rolled steel sheet.

The gist of the present invention made on the basis of the above findings is as follows.

(1) A hot-rolled steel sheet according to an aspect of the present invention comprising, as a chemical composition, in % by mass, C: 0.050 to 0.150%,
Si: 0.01 to 1.00%,
Mn: 1.00 to 2.50%,
P: 0.020% or less,
S: 0.005% or less,
N: 0.0050% or less,
Al: 0.001 to 0.100%,
Ti: 0.001 to 0.100%,
B: 0.0005 to 0.0050%,
Nb: 0 to 0.100%,
Cr: 0 to 1.00%,
V: 0 to 0.30%,
Cu: 0 to 0.30%,
Ni: 0 to 0.30%, and
Ca: 0 to 0.0050%, wherein the remainder comprising Fe and impurities, Vc represented by the following Expressions (1) to (3) is 10 to 40, a microstructure at a location of ¼ of a sheet thickness and at a location of 100 μm from a surface comprises, in area %, one or more of martensite and tempered martensite: 95% or more in total, and ferrite, bainite and pearlite: 5% or less in total, an average dislocation density at the location of 100 μm from the surface is 1.2 times or more of an average dislocation density at the location of ¼ of the sheet thickness:

when an effective amount of B≥0.0005% by mass is satisfied, $$Vc = 10^{2.94-0.75\times(2.7\times C+0.4\times Si+Mn+0.45\times Ni+0.8\times Cr)}$$

when an effective amount of B<0.0005% by mass is satisfied, $$Vc = 10^{3.69-0.75\times(2.7\times C+0.4\times Si+Mn+0.45\times Ni+0.8\times Cr)}, \quad (1)$$

an effective amount of B=10.81×(B/10.81−solid solution N amount/14.01) (2), and $$\text{solid solution N amount} = 14.01\times(N/14.01 - Ti/47.88), \quad (3)$$

here, each element symbol in the above Expression (1) is the content of the element in % by mass, and when the element is not contained, 0 is substituted, B in the above Expression (2) is a B content in % by mass, when the effective amount of B is a negative value, the effective amount of B is set to 0, N and Ti in the above Expression (3) are their contents in % by mass, and when the solid solution N amount is a negative value, the solid solution N amount is 0.

(2) The hot-rolled steel sheet according to the above (1) may comprise, as the chemical composition, in % by mass, one or two or more selected from the group consisting of, Nb: 0.005 to 0.100%, Cr: 0.005 to 1.00%, V: 0.005 to 0.30%, Cu: 0.005 to 0.30%, Ni: 0.005 to 0.30%, and Ca: 0.0010 to 0.0050%.

(3) In the hot-rolled steel sheet according to the above (1) or (2), the microstructure may have, at the location of ¼ of the sheet thickness, an average aspect ratio of prior austenite grains of 1.0 to 4.0.

(4) In the hot-rolled steel sheet according to any one of the above (1) to (3), the microstructure at the location of ¼ of the sheet thickness may have, an average grain size of prior austenite grains of 5 to 40 μm.

(5) In the hot-rolled steel sheet according to any one of the above (1) to (4), the microstructure at the location of 100 μm from the surface may have, a standard deviation of Vickers hardness of 15 Hv or less.

Advantageous Effects of Invention

According to the aspect associated with the present invention, it is possible to provide a hot-rolled steel sheet having high strength and fatigue limit, and excellent bendability.

Embodiment(s) for Implementing the Invention

A hot-rolled steel sheet according to an embodiment will be described in detail below. Here, the present invention is not limited only to the constitution disclosed in the present embodiment and various modifications are possible without departing from the gist of the present invention.

In a numerical limitation range which will be described below having numerical values having the term "to" written therebetween, a lower limit value and a higher limit value are included in the range. Numerical values written with the terms "less than" and "more than" are not included in the numerical value range. All "%" in chemical compositions refer to "% by mass."

In a chemical composition of a hot-rolled steel sheet according to the present embodiment comprises, in % by mass, C: 0.050 to 0.150%, Si: 0.01 to 1.00%, Mn: 1.00 to 2.50%, P: 0.020% or less, S: 0.005% or less, N: 0.0050% or less, Al: 0.001 to 0.100%, Ti: 0.001 to 0.100%, B: 0.0005 to 0.0050%, and the remainder: Fe and impurities. Each element will be described below.

C: 0.050 to 0.150%

C enhances the strength of a hot-rolled steel sheet. If the C content is less than 0.050%, the desired strength cannot be obtained. For this reason, the C content is set to 0.050% or more. The C content is preferably 0.070% or more or 0.080% or more.

On the other hand, if the C content is more than 0.150%, the fatigue limit of the hot-rolled steel sheet deteriorates, and the bendability deteriorates. For this reason, the C content is set to 0.150% or less. The C content is preferably 0.130% or less or 0.110% or less.

Si: 0.01 to 1.00%

Si enhances the strength of a hot-rolled steel sheet through solid-solution strengthening and improved hardenability. Furthermore, Si also has a deoxidizing effect. If the Si content is less than 0.01%, the above effect due to the action cannot be obtained. For this reason, the Si content is set to 0.01% or more. The Si content is preferably 0.05% or more, 0.10% or more or 0.15% or more.

On the other hand, if the Si content is more than 1.00%, ferrite transformation is accelerated and the desired microstructure cannot be obtained. As a result, the strength and the fatigue limit of the hot-rolled steel sheet deteriorate. For this reason, the Si content is set to 1.00% or less. The Si content is preferably 0.80% or less, 0.60% or less, 0.40% or less or 0.30% or less.

Mn: 1.00 to 2.50%

Mn enhances the strength of a hot-rolled steel sheet through solid-solution strengthening and improved hardenability. If the Mn content is less than 1.00%, the desired strength of the hot-rolled steel sheet cannot be obtained. In addition, the desired bendability and fatigue limit of the hot-rolled steel sheet cannot be obtained. For this reason, the Mn content is set to 1.00% or more. The Mn content is preferably 1.50% or more or 1.80% or more.

On the other hand, if the Mn content is more than 2.50%, the desired bendability of the hot-rolled steel sheet cannot be obtained. For this reason, the Mn content is set to 2.50% or less. The Mn content is preferably 2.30% or less or 2.20% or less.

P: 0.020% or Less

P lowers the fatigue limit of the hot-rolled steel sheet. I If the P content is more than 0.020%, the fatigue limit of the hot-rolled steel sheet remarkably deteriorates. For this reason, the P content is set to 0.020% or less. The P content is preferably 0.017% or less, 0.015% or less or 0.012% or less.

Since the lower the P content, the more preferable, the P content is preferably 0%. However, since excessive P reduction increases the cost of removing P, the P content may be 0.001% or more.

S: 0.005% or Less

S lowers the fatigue limit of the hot-rolled steel sheet. If the S content is more than 0.005%, the fatigue limit of the hot-rolled steel sheet remarkably deteriorates. For this reason, the S content is set to 0.005% or less. The S content is preferably 0.004% or less or 0.002% or less.

Since the lower the S content, the more preferable, the S content is preferably 0%. However, since excessive S reduction increases the cost of removing S, the S content may be 0.001% or more.

N: 0.0050% or Less

N lowers the workability of hot-rolled steel sheets. If the N content is more than 0.0050%, the workability of the hot-rolled steel sheet remarkably deteriorates. For this reason, the N content is set to 0.0050% or less. The N content is preferably 0.0040% or less or 0.0030% or less.

Since the lower the N content, the more preferable, the N content is preferably 0%. However, since excessive N reduction increases the cost of removing N, the N content may be 0.0010% or more.

Al: 0.001 to 0.100%

Al has the effect of cleaning steel through deoxidizing (preventing the occurrence of defects such as blowholes in steel). This effect cannot be obtained if the Al content is less than 0.001%. For this reason, the Al content is set to 0.001% or more. The Al content is preferably 0.003% or more, 0.005% or more or 0.010% or more.

On the other hand, the above effect is saturated even if the Al content is more than 0.100%. Furthermore, the desired microstructure cannot be obtained by accelerating ferrite transformation. For these reason, the Al content is set to 0.100% or less. The Al content is preferably 0.080% or less, 0.060% or less or 0.050% or less.

Ti: 0.001 to 0.100%

Ti enhances the strength of hot-rolled steel sheets by finely precipitating as a carbides in steel sheets. Furthermore, Ti forms a nitride to fix N and prevent coarsening of austenite grains. If the Ti content is less than 0.001%, the desired strength, bendability and fatigue limit of the hot-rolled steel sheet cannot be obtained. For this reason, the Ti content is set to 0.001% or more. The Ti content is preferably 0.005% or more or 0.010% or more.

On the other hand, if the Ti content is more than 0.100%, a large amount of coarse carbides and nitride precipitates in the steel and the desired strength, bendability and fatigue limit of the hot-rolled steel sheet cannot be obtained. For this reason, the Ti content is set to 0.100% or less. The Ti content is preferably 0.070% or less, 0.050% or less or 0.030% or less.

B: 0.0005 to 0.0050%

B increases the strength of hot-rolled steel sheets by significantly improving hardenability even with a small content of B through B segregated in the austenite grain boundaries. If the B content is less than 0.0005%, the above effect cannot be obtained and the desired strength of the hot-rolled steel sheet cannot be obtained. In addition, the desired bendability and fatigue limit of the hot-rolled steel sheet cannot be obtained. For this reason, the B content is set to 0.0005% or more. The B content is preferably 0.0010% or more or 0.0013% or more.

On the other hand, if the B content is more than 0.0050%, recrystallization of austenite during hot rolling is minimized, the rolling load increases, and the desired microstructure cannot be obtained. For this reason, the B content is set to 0.0050% or less. The B content is preferably 0.0040% or less or 0.0030% or less.

The remainder of the chemical composition of the hot-rolled steel sheet according to the present embodiment may be Fe and impurities. In the present embodiment, the impurities mean ores as raw materials, scrap, or materials mixed in from the manufacturing environment, or materials which are allowed within the range which does not adversely affect the hot-rolled steel sheet according to the present embodiment.

The chemical composition of the hot-rolled steel sheet according to the present embodiment may contain the following optional elements instead of a part of Fe. Lower limits of the contents when the optional elements are not contained are 0%. Each of the optional elements will be described below.

Nb: 0.005 to 0.100%

Nb precipitates in steel as carbide or nitride, and increases the strength of hot-rolled steel sheets. Also, these precipitates minimize the coarsening of austenite grains and accelerate the refinement of the microstructure. In order to reliably obtain these effects, the Nb content is preferably 0.005% or more.

On the other hand, if the Nb content is more than 0.100%, a large amount of coarse carbide and nitride precipitate in the steel and the workability of the hot-rolled steel sheet decreases. For this reason, the Nb content is set to 0.100% or less. Preferably, the Nb content is 0.030% or less.

Cr: 0.005 to 1.00%

Cr improves hardenability and increases the strength of hot rolled steel sheets. In order to reliably obtain this effect, the Cr content is preferably 0.005% or more.

On the other hand, if the Cr content is more than 1.00%, the weldability of the hot-rolled steel sheet decreases. For this reason, the Cr content is set to 1.00% or less.

The Cr content is preferably 0.30% or less.

V: 0.005 to 0.30%

V contributes to increasing the strength of hot-rolled steel sheets by forming a solid solution in steel, precipitates in steel sheets as carbide, nitride, or carbonitride, and contributes to increasing the strength of hot-rolled steel sheets even through precipitation strengthening. In order to reliably obtain these effects, the V content is preferably 0.005% or more.

On the other hand, if the V content is more than 0.30%, the toughness of the hot-rolled steel sheet decreases. For this reason, the V content is set to 0.30% or less. The V content is preferably 0.10% or less.

Cu: 0.005 to 0.30%

Cu forms a solid solution in steel, contributes to increasing the strength of hot-rolled steel sheets, and also contributes to improving corrosion resistance. In order to reliably obtain these effects, the Cu content is preferably 0.005% or more.

On the other hand, if the Cu content is more than 0.30%, the surface properties of the hot-rolled steel sheet deteriorate. For this reason, the Cu content is set to 0.30% or less. The Cu content is preferably 0.10% or less.

Ni: 0.005 to 0.30%

Ni forms a solid solution in steel, contributes to increasing the strength of the hot-rolled steel sheet, and contributes to improving toughness. In order to reliably obtain these effects, the Ni content is preferably 0.005% or more.

Ni is an expensive element, and if the Ni content is more than 0.30%, it causes an increase in alloy cost. For this reason, the Ni content is set to 0.30% or less. The Ni content is preferably 0.10% or less.

Ca: 0.0010 to 0.0050%

Ca refines oxides and nitrides which precipitate during solidification and improves the cleanliness of a steel ingot and a billet. In order to reliably obtain this effect, the Ca content is preferably 0.0010% or more.

On the other hand, even if more than 0.0050% of Ca is contained, the above effect is saturated, causing an increase in cost. For this reason, the Ca content is set to 0.0050% or less. The Ca content is preferably 0.0030% or less.

The chemical composition of the hot-rolled steel sheet may be measured through general analytical methods. For example, the chemical composition may be measured using inductively coupled plasma-atomic emission spectrometry (ICP-AES) or emission spectroscopic analysis (optical emission spectroscopy: OES). C and S may be measured using a combustion-infrared absorption method and N may be measured using an inert gas fusion-thermal conductivity method.

The chemical composition of the hot-rolled steel sheet according to the present embodiment has Vc of 10 to 40 represented by the following Expressions (1) to (3). If Vc is less than 10 or more than 40, the microstructure cannot be preferably controlled at the location of ¼ of the sheet thickness and/or the location of 100 μm from the surface, or the desired bendability of the hot-rolled steel sheet cannot be obtained. Vc is preferably 13 or more or 15 or more, and 35 or less or 33 or less.

An effective amount of B in the following Expression (1) corresponds to an amount of B which contributes to hardenability and can be obtained through the following Expression (2). Furthermore, a solid solution N amount in the following Expression (2) can be obtained through the following Expression (3).

When an effective amount of B≥0.0005% by mass is satisfied, $$Vc = 10^{2.94-0.75\times(2.7\times C+0.4\times Si+Mn+0.45\times Ni+0.8\times Cr)},$$

and when an effective amount of B<0.0005% by mass is satisfied, $$Vc = 10^{3.69-0.75\times(2.7\times C+0.4\times Si+Mn+0.45\times Ni+0.8\times Cr)} \quad (1)$$

$$\text{Effective amount of B} = 10.81\times(\text{B}/10.81 - \text{solid solution N amount}/14.01) \quad (2)$$

$$\text{Solid solution N amount} = 14.01\times(\text{N}/14.01 - \text{Ti}/47.88) \quad (3)$$

Each element symbol in the above Expression (1) is the content of the element in % by mass and 0 is substituted when the element is not contained.

B in the above Expression (2) is the B content in % by mass. When the effective amount of B is a negative value, the effective amount of B is set to 0.

N and Ti in the above Expression (3) are their contents in % by mass, respectively. When the solid solution N amount is a negative value, the solid solution N amount is set to 0.

The microstructure of the hot-rolled steel sheet according to the present embodiment will be descried below.

In the hot-rolled steel sheet according to the present embodiment, the microstructure at the location of ¼ of the sheet thickness and at the location of 100 μm from the surface comprises, in area %, one or more of martensite and tempered martensite: 95% or more in total, and ferrite, bainite, and pearlite: 5% or less in total, an average dislocation density at the location of 100 μm from the surface is 1.2 times or more of an average dislocation density at the location of ¼ of the sheet thickness.

Each requirement will be described in detail below.

Location of ¼ of Sheet Thickness

In the present embodiment, a location of ¼ of a sheet thickness specifically refers to a region from a location of "¼ of a sheet thickness from a surface" to 10 μm on the front and back sides, that is, a location at "¼ of the sheet thickness from the surface"−10 μm to a location at "¼ of the sheet thickness from the surface"+10 μm. In other words, the location of ¼ of the sheet thickness is a region whose starting point is the location at "¼ of the sheet thickness from the surface"−10 μm and whose ending point is the location at "¼ of the sheet thickness from the surface"+10 μm.

Location of 100 μm from Surface

In the present embodiment, a location of 100 μm from a surface specifically refers to a region from "a location of 100 μm from surface" to 10 μm on the front and back sides, that is, a location at 100-10 μm (90 μm) from the surface to a location at 100+10 μm (110 μm) from the surface. In other words, the location of 100 μm from a surface is a region whose starting point is the location at 90 μm from the surface and whose ending point is the location at 110 μm from the surface.

One or More of Martensite and Tempered Martensite: 95% or More in Total

Martensite and tempered martensite are hard, homogeneous and fine structures. High strength can be obtained by including these structures. If a total area ratio of these structures is less than 95%, the desired strength cannot be obtained. For this reason, a total area ratio of these structures is set to 95% or more. It is not necessary to include both martensite and tempered martensite, and even if only one of them is included, the area ratio may be 95% or more. A total area ratio of martensite and tempered martensite is preferably 97% or more, 98% or more or 99% or more. More preferably it is 100%.

Ferrite, Bainite and Pearlite: 5% or Less in Total

The hot-rolled steel sheet according to the present embodiment may comprise one or more of ferrite, bainite and pearlite as the remainder in microstructure other than martensite and tempered artensite in the microstructure at the location of ¼ of the sheet thickness and at the location of 100 μm from the surface. If a total area ratio of these structures is more than 5%, the desired amount of martensite and tempered martensite cannot be obtained, and the strength of the hot-rolled steel sheet decreases. For this reason, the total area ratio of one or more of ferrite, bainite and pearlite is 5% or less. Preferably it is 3% or less, 2% or less, or 1% or less. More preferably it is 0%.

The area ratio of each structure is measured by the following method.

A test piece is taken from the hot-rolled steel sheet so that the microstructure of the sheet surface parallel to the rolling direction at the location of 100 μm from the surface and at the location of ¼ of the sheet thickness can be observed respectively. Next, after polishing the sheet surface to expose the location of 100 μm from the surface and the location of ¼ of the sheet thickness from the surface, the polished surface is subjected to initial etching, and the location of 100 μm from the surface and the location of ¼ of the sheet thickness from the surface is subjected to structure observation using an optical microscope and a scanning electron microscope (SEM). The observation area is a rectangular area of 200 μm in the sheet width direction× 200 μm in the rolling direction on each sheet surface at the location of 100 μm from the surface and the location of ¼ the sheet thickness from the surface. The measurement is performed at least three areas in each location. Image analysis is performed on the structure image obtained by the structure observation, and the area ratio of each of ferrite, pearlite, bainite and tempered martensite is obtained.

Then, Le Pera etching is performed on the same observation positions, structure observation is then performed using an optical microscope and a scanning electron microscope, image analysis is performed on the obtained structure image, and thereby the area ratio of martensite is obtained.

In the above structure observation, each structure is identified by the following method.

Martensite is a structure having a high dislocation density and substructures such as blocks and packets within the grains so that it is possible to distinguish it from other microstructures according to electron channeling contrast images using the scanning electron microscope.

A structure that is an aggregation of lath-shaped grains and contains Fe-based carbides with a major axis of 20 nm or more and extending in different directions inside the structure is regarded as tempered martensite.

A structure that is an aggregation of lath-shaped grains, and is not martensite among structures that do not contain Fe-based carbides with a major axis of 20 nm or more inside the structure or a structure which contains Fe-based carbides with a major axis of 20 nm or more inside the structure and in which the Fe-based carbides have a single variant, that is, Fe-based carbides extending in the same direction, is regarded as bainite.

Here, Fe-based carbides elongated in the same direction are Fe-based carbides with a difference of 5° or less in the elongation direction.

A structure that is a lump of grains and does not contain substructures such as laths inside the structure is regarded as ferrite.

A structure in which plate-like ferrite and Fe-based carbides overlap in layers is regarded as pearlite.

Average Dislocation Density at Location of 100 μm from Surface: 1.2 Times or More of Average Dislocation Density at Location of ¼ of Sheet Thickness The fatigue limit of the hot-rolled steel sheet can be increased by increasing the average dislocation density at the location of 100 μm from the surface. If the average dislocation density at the location of 100 μm from the surface is less than 1.2 times of the average dislocation density at the location of ¼ of the sheet thickness, the desired fatigue limit cannot be obtained. For this reason, the average dislocation density at the location of 100 μm from the surface is set to 1.2 times or more of the average dislocation density at the location of ¼ of the sheet thickness. Preferably it is 1.3 times or more, 1.4 times or more or 1.5 times or more.

An upper limit is not particularly limited, but may be 3.0 times or lower or 2.0 times or lower.

The average dislocation density is measured by the following method.

A sample is cut out from the hot-rolled steel sheet so that the location of 100 μm from the surface and the location of ¼ of the sheet thickness can be measured. The size of the sample also depends on a measurement device but is set to a size that corresponds to about 20 mm square. The thickness of the sample is reduced using a mixed solution that is composed of 48% by volume of distilled water, 48% by volume of hydrogen peroxide solution, and 4% by volume of hydrofluoric acid. In this case, the same thickness is reduced from each of the surface and back of the sample, so that the location of 100 μm from the surface is exposed from the surface of the sample not yet reduced thickness. X-ray diffraction measurement is performed on this exposed surface to specify a plurality of diffraction peaks of a body-centered cubic lattice. An average dislocation density is analyzed from the half-widths of these diffraction peaks, so that the average dislocation density at the location of 100 μm from the surface is obtained. By further reducing the thickness using the mixed solution, the location of ¼ of the sheet thickness is exposed, and by measuring this position, the average dislocation density at the location of ¼ of the sheet thickness is obtained.

A modified Williamson-Hall method disclosed in "T. Ungar, three others, Journal of Applied Crystallography, 1999, Vol. 32, pp. 992 to 1002" is used as an analysis method.

It is preferable that the hot-rolled steel sheet according to the present embodiment have an average aspect ratio of prior austenite grains of 1.0 to 4.0 in the microstructure at the location of ¼ of the sheet thickness.

Also, in the microstructure at the location of ¼ of the sheet thickness, the average grain size of the prior austenite grains is preferably 5 to 40 μm.

Also, in the microstructure at the location of 100 μm from the surface, the standard deviation of Vickers hardness is preferably 15 Hv or less.

Average Aspect Ratio of Prior Austenite Grains: 1.0 to 4.0

In the microstructure at the location of ¼ of the sheet thickness, the anisotropy in the properties can be reduced by setting an average aspect ratio of prior austenite grains to 1.0 to 4.0, and as a result, the bendability of the hot-rolled steel sheet can be improved. For this reason, it is preferable to set the average aspect ratio of prior austenite grains to 1.0 to 4.0. The upper limit is preferably set to 3.5 or less, 3.2 or less or 3.0 or less.

The aspect ratios of the prior austenite grains are values obtained by dividing long axes of the prior austenite grains by short axes thereof and values of 1.0 or more are taken. As the aspect ratio decreases, the grains are equiaxed, and as the aspect ratio increases, the grains become flat. The aspect ratio is an index representing a degree of anisotropy of the properties.

Average Grain Size of Prior Austenite Grains: 5 to 40 μm

The bendability of the hot-rolled steel sheet can be improved by setting the average grain size of the prior austenite grains to 5 to 40 μm in the microstructure at the location of ¼ of the sheet thickness. The upper limit is preferably set to 35 μm or less or 30 μm or less. The lower limit is preferably set to 8 μm or more or 10 μm or more.

An average aspect ratio and an average grain size of prior austenite grains at the location of ¼ of the sheet thickness is measured by the following method.

A test piece is taken from a hot-rolled steel sheet so that the microstructure of the sheet surface parallel to a rolling direction at the location of ¼ of the sheet thickness can be observed. Prior austenite grain boundaries are revealed by corroding an observation surface using a picric acid saturated aqueous solution. Five or more fields of view of an enlarged photograph at the location of ¼ of the sheet thickness from the surface of a corrosion-treated sheet surface parallel to the rolling direction are photographed at a magnification of 1000 times using a scanning electron microscope (SEM). The photographic field is, in the sheet surface at the location of ¼ of the sheet thickness from the surface, an area of 200 μm in the sheet width direction×200 μm in the rolling direction. Equivalent circle diameters of at least 20 prior austenite grains having an equivalent circle diameter of 2 μm or more included in each SEM photograph are obtained through image processing. An average grain size of the prior austenite grains is obtained by calculating these average values.

When prior austenite grains having an equivalent circle diameter of less than 2 μm are included, the above measurements are performed excluding them.

Also, long axes and short axes of at least 20 prior austenite grains having an equivalent circle diameter of 2 μm or more, which are included in each of the above SEM photographs, are measured. An average long axis and an average short axis of the prior austenite grains are obtained by calculating average values of the long axes and the short axes obtained by measuring each of the prior austenite grains. An average aspect ratio of the prior austenite grains is obtained by calculating these ratios (average long axis/average short axis).

Standard Deviation of Vickers Hardness: 15 Hv or Less

By setting the standard deviation of Vickers hardness at the location of 100 μm from the surface to 15 Hv or less, the bendability of the hot-rolled steel sheet can be improved. For this reason, the standard deviation of Vickers hardness at the location of 100 μm from the surface is preferably 15 Hv or less. More preferably, it is 12 Hv or less, 10 Hv or less or 8 Hv or less.

A lower limit is not particularly limited, but may be 5 Hv or more.

Vickers hardness is measured by the following method in the present embodiment.

A sample is taken from the hot-rolled steel sheet, and the sheet thickness cross section is polished with waterproof abrasive paper. Next, after buffing using a diamond suspension, the Vickers hardness at the location of 100 μm from the surface is measured. The Vickers hardness is measured at 50 or more points at predetermined measurement intervals in accordance with JIS Z 2244-1:2020, and the standard deviation is calculated from the obtained measurement values. As a result, the standard deviation of Vickers hardness at the location of 100 μm from the surface is obtained.

A micro Vickers hardness tester is used to measure Vickers hardness. As the measurement conditions, a load is set to 0.98 N and a load holding time is set to 10 seconds.

Tensile Strength: 980 MPa or More

The hot-rolled steel sheet according to the present embodiment may have a tensile strength of 980 MPa or more. By setting the tensile strength to 980 MPa or more, the applicable components are not limited, and it is possible to make a greater contribution to reducing a weight of a vehicle body. Preferably, the tensile strength is 1000 MPa or more or 1100 MPa or more.

An upper limit is not particularly limited, but may be 1470 MPa from the viewpoint of mold wear suppression.

Tensile strength is measured in accordance with JIS Z 2241:2011 using No. 5 test piece of JIS Z 2241:2011. A sampling location of the tensile test piece is a central location in a sheet width direction and a direction perpendicular to the rolling direction may be the longitudinal direction.

Fatigue Limit: 0.45 or More

The hot-rolled steel sheet according to the present embodiment may have a fatigue limit (fatigue strength/tensile strength) of 0.45 or more. By setting the fatigue limit to 0.45 or more, the applicable components are not limited, and it is possible to make a greater contribution to reducing a weight of a vehicle body. The fatigue remit ratio is more preferably 0.47 or more.

The fatigue strength is measured using a Schenck plane bending fatigue tester in accordance with JIS Z 2275:1978. As the stress load of measurement, a test speed is set to 30 Hz with both swings, and the fatigue strength is measured at $10^7$ cycles. Then, by dividing the fatigue strength at $10^7$ cycles by the tensile strength measured by the above-mentioned tensile test, the fatigue limit (fatigue strength/tensile strength) is obtained.

R/t: 1.5 or Less

The hot-rolled steel sheet according to the present embodiment may have a ratio R/t of 1.5 or less between a limit bending radius R obtained through a test conforming to a V-block method which will be described later, and a sheet thickness t. If R/t is 1.5 or less, the applicable components are not limited, and it is possible to make a greater contribution to reducing a weight of a vehicle body.

R/t is obtained through the following method.

A 100 mm×30 mm strip-shaped test piece is cut out from a location of ½ of a width direction of the hot-rolled steel sheet. For bending (L-axis bending) in which a bending ridge line is parallel to the rolling direction (L direction), a test is performed in accordance with the V-block method (bending angle θ is 90°) of JIS Z 2248:2006. A critical bending R/t is obtained by obtaining a minimum bending radius R in which cracks do not occur and dividing the obtained minimum bending radius R by a sheet thickness t.

Here, for the presence or absence of cracks, cracks are observed by observing a bent surface of the test piece after a V-block 90° bending test with a magnifying glass or an optical microscope at a magnification of 10 times or more, and when a crack length observed on the bending surface of the test piece is more than 0.5 mm, it is determined that there is a crack.

Sheet Thickness: More Than 0.8 mm and 8.0 mm or Less

A sheet thickness of the hot-rolled steel sheet according to the present embodiment is not particularly limited, but may be more than 0.8 mm and 8.0 mm or less. If the sheet thickness of the hot-rolled steel sheet is 0.8 mm or less, it may become difficult to secure a rolling completion temperature and a rolling load may become excessive, making hot rolling difficult in some cases. Therefore, the sheet thickness of the hot-rolled steel sheet according to the present embodiment may be more than 0.8 mm, and preferably 1.2 mm or more or 1.4 mm or more.

On the other hand, if the sheet thickness is more than 8.0 mm, it may be difficult to obtain the microstructure described above in some cases. Therefore, the sheet thickness may be 8.0 mm or less, and preferably 6.0 mm or less.

Plated Layer

The hot-rolled steel sheet according to the present embodiment having the chemical composition and the microstructure described above may be a surface-treated steel sheet by providing a plated layer onto the surface for the purpose of improving corrosion resistance. The plated layer may be an electroplated layer or a hot-dipped plated layer. Examples of the electroplated layer include electrogalvanizing, electrolytic Zn—Ni alloy plating, and the like. Examples of the hot-dipped layer include hot dip galvanizing, alloyed hot dip galvanizing, hot-dip aluminum plating, hot-dip Zn—Al alloy plating, hot-dip Zn—Al—Mg alloy plating, hot-dip Zn—Al—Mg—Si alloy plating, and the like. An amount of plating to be deposited is not particularly limited and may be the same as that in the related art. Furthermore, corrosion resistance can be further increased by applying an appropriate chemical conversion treatment (for example, applying a silicate-based chromium-free chemical conversion treatment solution and drying it) after plating.

A preferred manufacturing method of the hot-rolled steel sheet according to the present embodiment will be described below. According to the following manufacturing method, the hot-rolled steel sheet according to the present embodiment can be stably manufactured.

A temperature explained below refers to a surface temperature of a slab or a hot-rolled steel sheet.

The preferred manufacturing method of the hot-rolled steel sheet according to the present embodiment includes the following steps.

(1) A slab having the above chemical composition is heated to a temperature range of 1100 to 1270° C.

(2) Rough rolling is performed so that a rough rolling completion temperature is a temperature range of 1000 to 1200° C.

(3) Finish rolling is performed so that a finishing temperature FT is a temperature range of higher than $Ac_3$ point+30° C. and 960° C. or lower, a cumulative reduction rate in final three stages is 50% to 70%, a steel sheet tension between a final stage and a first stage from the final stage is 2.0 to 5.0 kg/mm$^2$, and a cumulative reduction rate is 75% to 95%.

(4) Cooling is performed so that an average cooling rate in a temperature range from the finishing temperature FT to Ms point is Vc+40° C./s to Vc+70° C./s.

(5) Cooling is stopped in a temperature range of 200° C. or lower and then coiling is performed.

Each step will be described in detail below.

Heating Temperature of Slab: 1100 to 1270° C.

It is preferable to heat a slab with the above chemical composition to a temperature range of 1100 to 1270° C. When a heating temperature of the slab is lower than 1100° C., the deformation resistance in hot rolling may be high and a rolling load may increase in some cases. For this reason, the heating temperature of 1100° C. or higher is preferable.

On the other hand, if the heating temperature is higher than 1270° C., the prior austenite grains may coarsen, a low temperature toughness of the hot-rolled steel sheet may be lowered in some cases. For this reason, the heating temperature of 1270° C. or lower is preferable.

It is preferable that the slab to be heated is produced through continuous casting from the viewpoint of production cost, but it may be produced through other casting methods (for example, ingot casting method).

Rough Rolling Completion Temperature: 1000 to 1200° C.

Hot rolling is roughly divided into rough rolling and finish rolling. Making the slab a rough bar of desired dimensions and shape and making it easy to adjust the finishing temperature FT within the desired temperature range, it is preferable that rough rolling is performed so that the rough rolling completion temperature is 1000 to 1200° C.

Finishing Temperature FT: Higher Than $Ac_3$ Point+30° C. and 960° C. or Lower

By setting the finishing temperature FT to higher than $Ac_3$ point+30° C., it is possible to suppress a surface layer of the hot-rolled steel sheet from softening. As a result, the average dislocation density at the location of 100 μm from the surface can be increased. For this reason, it is preferable that the finishing temperature FT is set to higher than $Ac_3$ point+30° C.

On the other hand, by setting the finishing temperature FT to 960° C. or lower, the ratio between the average dislocation density at the location of 100 μm from the surface and the average dislocation density at the location of ¼ of the sheet thickness can be preferably controlled. For this reason, it is preferable that the finishing temperature FT is set to 960° C. or lower.

In the present embodiment, the $Ac_3$ point (° C.) is represented by the following expression:

$$Ac_3 + 937.2 - 436.5 \times C + 56 \times Si - 19.7 \times Mn - 16.3 \times Cu - 26.6 \times Ni - 4.9 \times Cr + 124.8 \times V + 136.3 \times Ti - 19.1 \times Nb + 198.4 \times Al + 3315 \times B.$$

Each element symbol in the above expression indicates the content of the element in % by mass and 0 is substituted when it is not contained.

Cumulative Reduction Rate in Final Three Stages: 50% to 70%

By setting the cumulative reduction ratio in the final three stages of finish rolling to 70% or less, it is possible to suppress the surface layer of the hot-rolled steel sheet from softening. As a result, the average dislocation density at the location of 100 μm from the surface can be increased. For this reason, it is preferable that the cumulative reduction rate in the final three stages is 70% or less.

Furthermore, by setting the cumulative reduction ratio of the final three stages to 50% or more, the ratio between the average dislocation density at the location of 100 μm from the surface and the average dislocation density at the location of ¼ of the sheet thickness can be preferably controlled. For this reason, it is preferable that the cumulative reduction rate in the final three stages is 50% or more.

When the inlet side sheet thickness of the second stage from the final stage of finish rolling is to, and the exit side sheet thickness of the final stage of finish rolling is t1, the cumulative reduction rate of the final three stages of finish rolling can be expressed as ((1−t1/t0)×100).

Steel Sheet Tension between Final Stage and First Stage from Final Stage: 2.0 to 5.0 kg/mm$^2$ In finish rolling, by setting the steel sheet tension between the final stage and the first stage from the final stage to 2.0 kg/mm$^2$ or more, friction preferably occurs between the mill rolls and the surface layer region of the steel sheet and loading shear strain can be introduced in the surface layer region. As a result, the average dislocation density at the location of 100 μm from the surface can be increased. For this reason, the steel sheet tension between the final stage and the first stage from the final stage is preferably set to 2.0 kg/mm$^2$ or more.

In addition, by setting the steel sheet tension to 5.0 kg/mm$^2$ or less, it is possible to suppress the steel sheet form breaking, and it is possible to stably perform finish rolling. For this reason, the steel sheet tension between the final stage and the first stage from the final stage is preferably set to 5.0 kg/mm$^2$ or less.

The steel sheet tension may be adjusted by increasing the number of rotations of the final stage and/or the first stage from the final stage, or by increasing louvers.

Cumulative Reduction Rate of Finish Rolling: 75 to 95%

By setting the cumulative reduction rate of finish rolling to 95% or less, it is possible to suppress the surface layer of the hot-rolled steel sheet from softening. As a result, the average dislocation density at the location of 100 μm from the surface can be increased. For this reason, it is preferable that the cumulative reduction rate in finish rolling is 95% or less.

Furthermore, by setting the cumulative reduction ratio of finish rolling to 75% or more, the ratio between the average dislocation density at the location of 100 μm from the surface and the average dislocation density at the location of ¼ of the sheet thickness can be preferably controlled. For this reason, it is preferable that the cumulative reduction rate in finish rolling is 75% or more.

When the inlet side sheet thickness before first stage of finish rolling is t0, and the exit side sheet thickness after final stage of finish rolling is t1, the cumulative reduction rate of finish rolling can be expressed as ((1−t1/t0)×100).

Average cooling rate in temperature range from finishing temperature FT to Ms point:

$$Vc + 40° \text{ C./s to } Vc + 70° \text{ C./s}$$

After finish rolling is completed, the desired microstructure can be obtained by performing cooling using water to a temperature range in which austenite transforms to martensite. The area ratio of martensite and tempered martensite can be increased by setting the average cooling rate at the temperature range from finishing temperature FT to Ms point to Vc+40° C./s or faster. For this reason, the average cooling rate in the above temperature range is preferably set to Vc+40° C./s or faster.

Further, by setting the average cooling rate in the above temperature range to Vc+70° C./s or slower, it is possible to suppress a decrease in the toughness of the hot-rolled steel sheet. For this reason, the average cooling rate in the above temperature range is preferably set to Vc+70° C./s or slower.

It is preferable that the water cooling with the above average cooling rate is performed to a cooling stop temperature which will be described later.

The average cooling rate mentioned herein is a value obtained by dividing a temperature difference between a starting point and an ending point in a set range by an elapsed time from the starting point to the ending point.

Vc is represented by the above Expressions (1) to (3).

The Ms point is represented by the following expression:

$$Ms = 561 - 474 \times C - 33 \times Mn - 17 \times Ni.$$

Each element symbol in the above expression indicates the content of the element in % by mass and 0 is substituted when it is not contained.

Cooling Stop Temperature (Coiling Temperature): 200° C. or Lower

The cooling stop temperature is preferably set to 200° C. or lower. By setting the cooling stop temperature to 200° C. or lower, the desired amount of tempered martensite and martensite can be obtained. More preferably, it is 150° C. or lower, and even more preferably, it is 100° C. or lower. After cooling is stopped, coiling is performed.

Although the lower limit of the cooling stop temperature is not particularly limited, it may be room temperature (25° C.).

The hot-rolled steel sheet according to the present embodiment can be stably manufactured through the method described above. If necessary, the plated layer described above may be formed on the surface of the hot-rolled steel sheet.

EXAMPLES

Slabs having chemical compositions shown in Table 1 were manufactured through continuous casting. Hot-rolled steel sheets shown in Tables 3A and 3B were manufactured under the conditions shown in Tables 2A and 2B using the obtained slab. Coiling was performed immediately after cooling to cooling stop temperatures listed in Table 2B. The steel sheet tension indicates the steel sheet tension between the final stage and the first stage from the final stage.

The sheet thicknesses of the obtained hot-rolled steel sheets were more than 0.8 mm and 8.0 mm or less.

For the obtained hot-rolled steel sheets, a microstructure and an average dislocation density at a location of ¼ of a sheet thickness and a location of 100 μm from a surface, a tensile strength, a fatigue limit, and R/t were measured by the above method. Furthermore, a total elongation (%) was obtained from a tensile test performed by the above method. In some comparative examples, retained structures such as ferrite became the main phase, and prior austenite grain boundaries could not be made to appear.

The obtained results are shown in Tables 3A, 3B and 4. In addition, M indicates martensite, TM indicates tempered martensite, F indicates ferrite, B indicates bainite, and P indicates pearlite.

When the tensile strength was 980 MPa or more, it was determined as having high strength and being successful. On the other hand, when the tensile strength was less than 980 MPa, it was determined as having poor strength and being not successful.

When the fatigue limit was 0.45 or more, it was determined as having high fatigue limit and being successful. On the other hand, when the fatigue limit was less than 0.45, it was determined as not having high fatigue limit and being not successful.

When R/t was 1.5 or less, it was determined as having excellent bendability and being successful. On the other hand, when R/t was more than 1.5, it was determined as not having excellent bendability and being not successful.

TABLE 1

| | Chemical Composition (% by mass) Remainder being Fe and impurities | | | | | | | | | | | |
|---|---|---|---|---|---|---|---|---|---|---|---|---|
| Steel | C | Si | Mn | P | S | N | Al | Ti | B | Nb | Cr | V |
| A | 0.080 | 0.05 | 2.15 | 0.011 | 0.002 | 0.0037 | 0.030 | 0.020 | 0.0020 | | | |
| B | 0.148 | 0.21 | 1.40 | 0.012 | 0.003 | 0.0037 | 0.030 | 0.010 | 0.0023 | | | |
| C | 0.051 | 0.32 | 2.00 | 0.011 | 0.002 | 0.0034 | 0.040 | 0.030 | 0.0021 | | 0.09 | |
| D | 0.090 | 0.01 | 2.10 | 0.011 | 0.002 | 0.0043 | 0.070 | 0.050 | 0.0023 | | | |
| E | 0.110 | 0.91 | 1.50 | 0.011 | 0.003 | 0.0044 | 0.030 | 0.020 | 0.0025 | | | |
| F | 0.142 | 0.41 | 1.10 | 0.012 | 0.002 | 0.0037 | 0.040 | 0.020 | 0.0019 | | 0.31 | |
| G | 0.058 | 0.33 | 2.48 | 0.011 | 0.004 | 0.0047 | 0.030 | 0.015 | 0.0005 | | 0.11 | |
| H | 0.090 | 0.21 | 2.03 | 0.012 | 0.002 | 0.0036 | 0.030 | 0.095 | 0.0020 | | | |
| I | 0.075 | 0.05 | 2.11 | 0.011 | 0.002 | 0.0043 | 0.030 | 0.001 | 0.0039 | | | |
| J | 0.121 | 0.11 | 2.21 | 0.011 | 0.003 | 0.0049 | 0.030 | 0.002 | 0.0050 | | | |
| K | 0.108 | 0.31 | 1.90 | 0.011 | 0.001 | 0.0033 | 0.040 | 0.020 | 0.0005 | | 0.19 | |
| L | 0.071 | 0.05 | 2.13 | 0.011 | 0.002 | 0.0030 | 0.030 | 0.020 | 0.0021 | 0.030 | | |
| M | 0.071 | 0.02 | 2.11 | 0.011 | 0.003 | 0.0040 | 0.030 | 0.020 | 0.0019 | | 0.11 | |
| N | 0.080 | 0.11 | 1.91 | 0.011 | 0.002 | 0.0032 | 0.030 | 0.020 | 0.0019 | | | 0.09 |
| O | 0.160 | 0.21 | 2.00 | 0.011 | 0.002 | 0.0039 | 0.030 | 0.021 | 0.0021 | | | |
| P | 0.040 | 0.11 | 2.10 | 0.011 | 0.003 | 0.0033 | 0.030 | 0.022 | 0.0022 | | | |
| Q | 0.051 | 1.10 | 1.50 | 0.012 | 0.002 | 0.0038 | 0.030 | 0.020 | 0.0008 | | | |
| R | 0.110 | 0.11 | 2.55 | 0.011 | 0.002 | 0.0034 | 0.030 | 0.015 | 0.0015 | | | |
| S | 0.147 | 0.11 | 0.93 | 0.011 | 0.003 | 0.0030 | 0.030 | 0.015 | 0.0018 | | | |
| T | 0.080 | 0.11 | 2.10 | 0.012 | 0.002 | 0.0041 | 0.030 | 0.120 | 0.0021 | | | |
| U | 0.080 | 0.12 | 2.10 | 0.011 | 0.002 | 0.0049 | 0.030 | 0.000 | 0.0021 | | | |
| V | 0.080 | 0.11 | 2.30 | 0.012 | 0.003 | 0.0042 | 0.030 | 0.030 | 0.0004 | | | |

TABLE 1-continued

| | | | | | | | | | |
|---|---|---|---|---|---|---|---|---|---|
| W | 0.060 | 0.05 | 1.59 | 0.012 | 0.002 | 0.0041 | 0.030 | 0.030 | 0.0021 |
| X | 0.150 | 0.05 | 2.20 | 0.011 | 0.003 | 0.0038 | 0.030 | 0.028 | 0.0025 |
| Y | 0.083 | 0.13 | 2.30 | 0.011 | 0.002 | 0.0035 | 0.005 | 0.010 | 0.0022 |

| | Chemical Composition (% by mass) Remainder being Fe and impurities | | | | | | |
|---|---|---|---|---|---|---|---|
| Steel | Cu | Ni | Ca | Solid solution N amount | Effective amount of B | Vc | Remarks |
| A | | | | 0.000 | 0.0020 | 14 | Steel in present invention |
| B | | | | 0.001 | 0.0017 | 34 | Steel in present invention |
| C | | | | 0.000 | 0.0021 | 15 | Steel in present invention |
| D | | | | 0.000 | 0.0023 | 15 | Steel in present invention |
| E | | | | 0.000 | 0.0025 | 21 | Steel in present invention |
| F | | | | 0.000 | 0.0019 | 33 | Steel in present invention |
| G | | | | 0.000 | 0.0003 | 35 | Steel in present invention |
| H | | | | 0.000 | 0.0020 | 15 | Steel in present invention |
| I | | | | 0.004 | 0.0008 | 16 | Steel in present invention |
| J | | | | 0.004 | 0.0017 | 10 | Steel in present invention |
| K | | | | 0.000 | 0.0005 | 12 | Steel in present invention |
| L | | | | 0.000 | 0.0021 | 15 | Steel in present invention |
| M | 0.09 | 0.04 | 0.0020 | 0.000 | 0.0019 | 13 | Steel in present invention |
| N | | | | 0.000 | 0.0019 | 21 | Steel in present invention |
| O | | | | 0.000 | 0.0021 | 11 | Comparative steel |
| P | | | | 0.000 | 0.0022 | 18 | Comparative steel |
| Q | | | | 0.000 | 0.0008 | 24 | Comparative steel |
| R | | | | 0.000 | 0.0015 | 6 | Comparative steel |
| S | | | | 0.000 | 0.0018 | 82 | Comparative steel |
| T | | | | 0.000 | 0.0021 | 15 | Comparative steel |
| U | | | | 0.005 | 0.0000 | 83 | Comparative steel |
| V | | | | 0.000 | 0.0004 | 59 | Comparative steel |
| W | | | | 0.000 | 0.0021 | 41 | Comparative steel |
| X | | | | 0.000 | 0.0025 | 9 | Comparative steel |
| Y | | | | 0.001 | 0.0018 | 10 | Steel in present invention |

Underlines indicate that the values are outside of the present invention.

TABLE 2A

| | | Rough rolling | | | Finish rolling | | | |
|---|---|---|---|---|---|---|---|---|
| No. | Steel type | Heating temperature ° C. | Rough rolling completion temperature ° C. | $Ac_3$ ° C. | Finishing temperature FT ° C. | Steel sheet tensile strength kg/mm$^2$ | Rolling reduction rate in final three stages % | Cumulative reduction rate % |
| 1 | A | 1250 | 1180 | 878 | 930 | 2.4 | 55 | 88 |
| 2 | B | 1250 | 1190 | 872 | 945 | 2.4 | 60 | 92 |
| 3 | C | 1270 | 1190 | 912 | 958 | 2.3 | 65 | 90 |
| 4 | D | 1250 | 1180 | 885 | 940 | 2.4 | 58 | 90 |
| 5 | E | 1250 | 1190 | 928 | 960 | 2.5 | 60 | 90 |
| 6 | F | 1240 | 1170 | 892 | 940 | 2.3 | 54 | 92 |
| 7 | G | 1250 | 1180 | 891 | 945 | 2.4 | 56 | 88 |
| 8 | H | 1270 | 1200 | 895 | 960 | 2.2 | 50 | 80 |
| 9 | I | 1250 | 1180 | 885 | 930 | 2.3 | 50 | 88 |
| 10 | J | 1250 | 1180 | 870 | 945 | 2.2 | 55 | 90 |
| 11 | K | 1250 | 1180 | 881 | 940 | 2.1 | 57 | 92 |
| 12 | L | 1270 | 1190 | 882 | 945 | 2.2 | 60 | 90 |
| 13 | M | 1270 | 1190 | 878 | 945 | 2.1 | 60 | 90 |
| 14 | N | 1270 | 1190 | 897 | 950 | 2.1 | 50 | 88 |
| 15 | O | 1250 | 1180 | 855 | 940 | 2.3 | 55 | 92 |
| 16 | P | 1250 | 1180 | 901 | 935 | 2.2 | 55 | 90 |
| 18 | Q | 1250 | 1180 | 958 | 940 | 2.1 | 50 | 88 |
| 19 | R | 1250 | 1180 | 858 | 945 | 2.3 | 55 | 92 |
| 20 | S | 1250 | 1190 | 875 | 940 | 2.4 | 60 | 88 |
| 21 | T | 1250 | 1190 | 896 | 945 | 2.4 | 55 | 88 |
| 22 | U | 1250 | 1190 | 881 | 935 | 2.5 | 55 | 88 |
| 23 | V | 1250 | 1190 | 874 | 945 | 2.3 | 55 | 88 |
| 24 | W | 1250 | 1190 | 899 | 960 | 2.4 | 55 | 88 |
| 25 | X | 1250 | 1190 | 849 | 940 | 2.5 | 55 | 88 |
| 26 | A | 1270 | 1210 | 878 | 985 | 2.1 | 50 | 88 |
| 27 | A | 1250 | 1140 | 878 | 905 | 2.3 | 55 | 88 |
| 28 | A | 1250 | 1190 | 878 | 950 | 1.9 | 55 | 88 |
| 29 | A | 1250 | 1190 | 878 | 950 | 2.3 | 45 | 88 |

TABLE 2A-continued

| | | Rough rolling | | Finish rolling | | | | |
|---|---|---|---|---|---|---|---|---|
| No. | Steel type | Heating temperature ° C. | Rough rolling completion temperature ° C. | $Ac_3$ ° C. | Finishing temperature FT ° C. | Steel sheet tensile strength kg/mm$^2$ | Rolling reduction rate in final three stages % | Cumulative reduction rate % |
| 30 | A | 1250 | 1190 | 878 | 950 | 2.3 | 75 | 88 |
| 31 | A | 1250 | 1190 | 878 | 950 | 2.3 | 55 | 88 |
| 32 | A | 1250 | 1190 | 878 | 950 | 2.3 | 70 | 96 |
| 33 | A | 1250 | 1190 | 878 | 950 | 2.3 | 50 | 70 |
| 34 | A | 1250 | 1180 | 878 | 935 | 2.3 | 55 | 88 |
| 35 | H | 1270 | 1200 | 895 | 960 | 2.1 | 50 | 80 |
| 36 | Y | 1250 | 1180 | 873 | 925 | 2.4 | 55 | 88 |

Underlines indicate that the manufacturing conditions are not preferable.

TABLE 2B

| | | Cooling | | | | |
|---|---|---|---|---|---|---|
| No. | Steel type | Vc | Average cooling rate at temperature range of FT to Ms point ° C./s | Ms ° C. | Cooling step temperature ° C. | Remarks |
| 1 | A | 14 | 65 | 452 | 115 | Example of present invention |
| 2 | B | 34 | 80 | 445 | 101 | Example of present invention |
| 3 | C | 15 | 75 | 471 | 92 | Example of present invention |
| 4 | D | 15 | 80 | 449 | 108 | Example of present invention |
| 5 | E | 21 | 70 | 459 | 92 | Example of present invention |
| 6 | F | 33 | 80 | 457 | 103 | Example of present invention |
| 7 | G | 35 | 80 | 452 | 93 | Example of present invention |
| 8 | H | 15 | 60 | 451 | 104 | Example of present invention |
| 9 | I | 16 | 60 | 456 | 98 | Example of present invention |
| 10 | J | 10 | 55 | 431 | 108 | Example of present invention |
| 11 | K | 12 | 60 | 447 | 103 | Example of present invention |
| 12 | L | 15 | 80 | 457 | 91 | Example of present invention |
| 13 | M | 13 | 80 | 457 | 110 | Example of present invention |
| 14 | N | 21 | 65 | 460 | 98 | Example of present invention |
| 15 | O | 11 | 60 | 419 | 103 | Comparative example |
| 16 | P | 18 | 70 | 473 | 114 | Comparative example |
| 18 | Q | 24 | 65 | 487 | 91 | Comparative example |
| 19 | R | 6 | 60 | 425 | 113 | Comparative example |
| 20 | S | 82 | 80 | 461 | 92 | Comparative example |
| 21 | T | 15 | 80 | 454 | 103 | Comparative example |
| 22 | U | 83 | 90 | 454 | 107 | Comparative example |
| 23 | V | 59 | 80 | 447 | 102 | Comparative example |
| 24 | W | 41 | 85 | 480 | 114 | Comparative example |
| 25 | X | 9 | 75 | 417 | 98 | Comparative example |
| 26 | A | 14 | 70 | 452 | 91 | Comparative example |
| 27 | A | 14 | 80 | 452 | 102 | Comparative example |
| 28 | A | 14 | 65 | 452 | 110 | Comparative example |
| 29 | A | 14 | 65 | 452 | 105 | Comparative example |
| 30 | A | 14 | 65 | 452 | 109 | Comparative example |
| 31 | A | 14 | 50 | 452 | 91 | Comparative example |
| 32 | A | 14 | 65 | 452 | 105 | Comparative example |
| 33 | A | 14 | 65 | 452 | 110 | Comparative example |
| 34 | A | 14 | 60 | 452 | 210 | Comparative example |
| 35 | H | 15 | 55 | 451 | 97 | Example of present invention |
| 36 | Y | 10 | 55 | 446 | 110 | Example of present invention |

Underlines indicate that the manufacturing conditions are not preferable.

TABLE 3A

| No. | Steel type | Location of ¼ of sheet thickness: M + TM area % | F + B + P area % | Average aspect ratio of prior γ grains — | Average grain size of prior γ grains μm | Location of 100 μm from surface: M + TM area % | F + B + P area % | Standard deviation of Vickers hardness Hv |
|---|---|---|---|---|---|---|---|---|
| 1 | A | 100 | 0 | 2.3 | 39 | 100 | 0 | 13 |
| 2 | B | 100 | 0 | 2.4 | 44 | 100 | 0 | 14 |
| 3 | C | 100 | 0 | 4.2 | 36 | 100 | 0 | 14 |
| 4 | D | 100 | 0 | 4.2 | 35 | 100 | 0 | 14 |
| 5 | E | 100 | 0 | 4.2 | 35 | 100 | 0 | 14 |
| 6 | F | 100 | 0 | 3.0 | 42 | 100 | 0 | 15 |
| 7 | G | 97 | 3 | 3.6 | 38 | 95 | 5 | 14 |
| 8 | H | 100 | 0 | 7.0 | 44 | 100 | 0 | 15 |
| 9 | I | 100 | 0 | 2.1 | 31 | 100 | 0 | 14 |
| 10 | J | 100 | 0 | 2.1 | 32 | 100 | 0 | 14 |
| 11 | K | 100 | 0 | 2.2 | 30 | 100 | 0 | 15 |
| 12 | L | 100 | 0 | 2.3 | 21 | 100 | 0 | 8 |
| 13 | M | 100 | 0 | 2.4 | 34 | 100 | 0 | 15 |
| 14 | N | 100 | 0 | 3.1 | 36 | 100 | 0 | 13 |
| 15 | O | 100 | 0 | 3.2 | 41 | 100 | 0 | 14 |
| 16 | P | 100 | 0 | 3.2 | 39 | 100 | 0 | 13 |
| 18 | Q | 88 | 12 | 3.1 | 35 | 87 | 13 | 17 |
| 19 | R | 100 | 0 | 3.2 | 34 | 100 | 0 | 12 |
| 20 | S | 12 | 88 | — | — | 15 | 85 | 17 |
| 21 | T | 100 | 0 | 3.2 | 32 | 100 | 0 | 14 |
| 22 | U | 13 | 87 | — | — | 12 | 88 | 22 |
| 23 | V | 18 | 82 | — | — | 19 | 81 | 24 |
| 24 | W | 90 | 10 | 2.8 | 38 | 90 | 10 | 18 |
| 25 | X | 100 | 0 | 3.1 | 38 | 100 | 0 | 14 |
| 26 | A | 100 | 0 | 1.8 | 51 | 100 | 0 | 13 |
| 27 | A | 100 | 0 | 4.2 | 21 | 100 | 0 | 8 |
| 28 | A | 100 | 0 | 2.3 | 39 | 100 | 0 | 15 |
| 29 | A | 100 | 0 | 2.1 | 44 | 100 | 0 | 14 |
| 30 | A | 100 | 0 | 8.2 | 30 | 100 | 0 | 15 |
| 31 | A | 94 | 6 | 2.3 | 41 | 94 | 6 | 17 |
| 32 | A | 100 | 0 | 9.1 | 20 | 100 | 0 | 15 |
| 33 | A | 100 | 0 | 1.8 | 55 | 100 | 0 | 18 |
| 34 | A | 94 | 6 | 2.3 | 40 | 94 | 6 | 18 |
| 35 | H | 100 | 0 | 6.9 | 45 | 100 | 0 | 17 |
| 36 | Y | 100 | 0 | 2.4 | 37 | 100 | 0 | 13 |

Underlines indicate that the values are outside of the present invention or the property values are not preferable.

40

TABLE 3B

| No. | Steel type | Average dislocation density: Location of ¼ of sheet thickness × $10^{15}$ | Location of 100 μm from surface × $10^{15}$ | Ratio of dislocation density (location of 100 μm from surface/location of ¼ of sheet thickness) | Remarks |
|---|---|---|---|---|---|
| 1 | A | 2.10 | 2.73 | 1.3 | Example of present invention |
| 2 | B | 2.40 | 3.12 | 1.3 | Example of present invention |
| 3 | C | 1.90 | 2.66 | 1.4 | Example of present invention |
| 4 | D | 2.20 | 2.86 | 1.3 | Example of present invention |
| 5 | E | 2.30 | 3.45 | 1.5 | Example of present invention |
| 6 | F | 2.10 | 2.73 | 1.3 | Example of present invention |
| 7 | G | 1.80 | 2.34 | 1.3 | Example of present invention |
| 8 | H | 2.20 | 2.86 | 1.3 | Example of present invention |
| 9 | I | 2.20 | 2.64 | 1.2 | Example of present invention |
| 10 | J | 2.30 | 2.99 | 1.3 | Example of present invention |
| 11 | K | 2.20 | 2.64 | 1.2 | Example of present invention |
| 12 | L | 2.20 | 3.52 | 1.6 | Example of present invention |
| 13 | M | 2.20 | 2.64 | 1.2 | Example of present invention |
| 14 | N | 2.20 | 2.64 | 1.2 | Example of present invention |
| 15 | O | 2.40 | 2.88 | 1.2 | Comparative example |
| 16 | P | 2.10 | 2.52 | 1.2 | Comparative example |
| 18 | Q | 0.42 | 0.42 | 1.0 | Comparative example |
| 19 | R | 2.30 | 2.99 | 1.3 | Comparative example |
| 20 | S | 0.24 | 0.24 | 1.0 | Comparative example |
| 21 | T | 0.19 | 0.19 | 1.0 | Comparative example |
| 22 | U | 0.20 | 0.22 | 1.1 | Comparative example |

TABLE 3B-continued

| No. | Steel type | Average dislocation density: Location of ¼ of sheet thickness × $10^{15}$ | Location of 100 μm from surface × $10^{15}$ | Ratio of dislocation density (location of 100 μm from surface/location of ¼ of sheet thickness) | Remarks |
|---|---|---|---|---|---|
| 23 | V | 0.22 | 0.24 | 1.1 | Comparative example |
| 24 | W | 0.23 | 0.23 | 1.0 | Comparative example |
| 25 | X | 2.60 | 3.12 | 1.2 | Comparative example |
| 26 | A | 2.10 | 2.10 | 1.0 | Comparative example |
| 27 | A | 2.90 | 3.15 | 1.1 | Comparative example |
| 28 | A | 2.10 | 2.31 | 1.1 | Comparative example |
| 29 | A | 2.10 | 2.31 | 1.1 | Comparative example |
| 30 | A | 4.21 | 4.32 | 1.0 | Comparative example |
| 31 | A | 1.80 | 2.16 | 1.2 | Comparative example |
| 32 | A | 2.30 | 2.53 | 1.1 | Comparative example |
| 33 | A | 2.40 | 2.64 | 1.1 | Comparative example |
| 34 | A | 1.96 | 2.64 | 1.3 | Comparative example |
| 35 | H | 2.15 | 2.74 | 1.3 | Example of present invention |
| 36 | Y | 2.12 | 2.73 | 1.3 | Example of present invention |

Underlines indicate that the values are outside of the present invention or the property values are not preferable.

TABLE 4

| No. | Type of steel | Tensile strength MPa | Total elongation % | R/t — | Fatigue limit | Remarks |
|---|---|---|---|---|---|---|
| 1 | A | 1070 | 9.5 | 1.0 | 0.46 | Example of present invention |
| 2 | B | 1374 | 8.6 | 1.5 | 0.45 | Example of present invention |
| 3 | C | 990 | 9.7 | 1.2 | 0.45 | Example of present invention |
| 4 | D | 1130 | 9.6 | 1.2 | 0.45 | Example of present invention |
| 5 | E | 1220 | 9.2 | 1.2 | 0.45 | Example of present invention |
| 6 | F | 1339 | 9.1 | 1.2 | 0.45 | Example of present invention |
| 7 | G | 992 | 9.9 | 1.0 | 0.47 | Example of present invention |
| 8 | H | 1139 | 9.5 | 1.5 | 0.46 | Example of present invention |
| 9 | I | 1076 | 9.5 | 1.2 | 0.47 | Example of present invention |
| 10 | J | 1257 | 9.2 | 1.2 | 0.47 | Example of present invention |
| 11 | K | 1193 | 9.5 | 1.2 | 0.47 | Example of present invention |
| 12 | L | 1055 | 9.1 | 1.0 | 0.47 | Example of present invention |
| 13 | M | 1040 | 9.2 | 1.2 | 0.47 | Example of present invention |
| 14 | N | 1101 | 9.3 | 1.2 | 0.45 | Example of present invention |
| 15 | O | 1432 | 8.5 | 1.6 | 0.43 | Comparative example |
| 16 | P | 851 | 10.8 | 1.0 | 0.45 | Comparative example |
| 18 | Q | 813 | 11.2 | 1.0 | 0.43 | Comparative example |
| 19 | R | 1231 | 11.2 | 1.6 | 0.45 | Comparative example |
| 20 | S | 911 | 13.2 | 2.0 | 0.41 | Comparative example |
| 21 | T | 821 | 13.4 | 1.6 | 0.43 | Comparative example |
| 22 | U | 811 | 13.2 | 2.0 | 0.43 | Comparative example |
| 23 | V | 843 | 13.1 | 2.0 | 0.43 | Comparative example |
| 24 | W | 911 | 11.1 | 1.5 | 0.41 | Comparative example |
| 25 | X | 1388 | 8.0 | 2.0 | 0.45 | Comparative example |
| 26 | A | 1058 | 9.7 | 1.5 | 0.43 | Comparative example |
| 27 | A | 1089 | 9.1 | 1.6 | 0.45 | Comparative example |
| 28 | A | 1060 | 9.5 | 1.2 | 0.43 | Comparative example |
| 29 | A | 1062 | 9.8 | 1.0 | 0.43 | Comparative example |
| 30 | A | 1054 | 9.6 | 1.8 | 0.45 | Comparative example |
| 31 | A | 1089 | 9.1 | 1.5 | 0.42 | Comparative example |
| 32 | A | 1092 | 8.9 | 2.0 | 0.44 | Comparative example |
| 33 | A | 1065 | 9.4 | 1.8 | 0.43 | Comparative example |
| 34 | A | 964 | 10.7 | 1.8 | 0.42 | Comparative example |
| 35 | H | 1121 | 9.7 | 1.5 | 0.45 | Example of present invention |
| 36 | Y | 1084 | 9.5 | 1.0 | 0.46 | Example of present invention |

Underlines indicate that the values are outside of the present invention or the property values are not preferable.

Looking at Tables 3A, 3B and 4, it can be seen that the hot-rolled steel sheets according to the examples of the present invention have high strength and fatigue limit, and excellent bendability.

On the other hand, it can be seen that the hot-rolled steel sheets according to the comparative examples are inferior in at least one of the above properties.

INDUSTRIAL APPLICABILITY

According to the above aspect of the present invention, a hot-rolled steel sheet having high strength and fatigue limit, and excellent bendability can be provided.

The invention claimed is:

1. A hot-rolled steel sheet comprising, as a chemical composition, in % by mass, C: 0.050 to 0.150%,
Si: 0.01 to 1.00%,
Mn: 1.00 to 2.50%,
P: 0.020% or less,
S: 0.005% or less,
N: 0.0050% or less,
Al: 0.001 to 0.100%,
Ti: 0.001 to 0.100%,
B: 0.0005 to 0.0050%,
Nb: 0 to 0.100%,
Cr: 0 to 1.00%,
V: 0 to 0.30%,
Cu: 0 to 0.30%,
Ni: 0 to 0.30%, and
Ca: 0 to 0.0050%, wherein the remainder comprising Fe and impurities, Vc represented by the following Expressions (1) to (3) is 10 to 40, a microstructure at a location of ¼ of a sheet thickness and at a location of 100 μm from a surface comprises, in area %, one or more of martensite and tempered martensite: 95% or more in total, and ferrite, bainite and pearlite: 5% or less in total, an average dislocation density at the location of 100 μm from the surface is 1.2 times or more of an average dislocation density at the location of ¼ of the sheet thickness:

when an effective amount of B≥0.0005% by mass is satisfied, $$Vc = 10^{2.94-0.75\times(2.7\times C+0.4\times Si+Mn+0.45\times Ni+0.8\times Cr)}$$

when an effective amount of B<0.0005% by mass is satisfied, $$Vc = 10^{3.69-0.75\times(2.7\times C+0.4\times Si+Mn+0.45\times Ni+0.8\times Cr)}, \quad (1)$$

an effective amount of B = (2)

-continued $$10.81\times(B/10.81 - \text{solid solution N amount}/14.01),$$

and $$\text{solid solution N amount} = 14.01\times(N/14.01 - Ti/47.88), \quad (3)$$

here, each element symbol in the above Expression (1) is the content of the element in % by mass, and when the element is not contained, 0 is substituted, B in the above Expression (2) is a B content in % by mass, when the effective amount of B is a negative value, the effective amount of B is set to 0, N and Ti in the above Expression (3) are their contents in % by mass, and when the solid solution N amount is a negative value, the solid solution N amount is 0.

2. The hot-rolled steel sheet according to claim 1, wherein the microstructure at the location of ¼ of the sheet thickness has, an average aspect ratio of prior austenite grains of 1.0 to 4.0.

3. The hot-rolled steel sheet according to claim 1, wherein the microstructure at the location of 100 μm from the surface has, a standard deviation of Vickers hardness of 15 Hv or less.

4. The hot-rolled steel sheet according to claim 1 comprising, as the chemical composition, in % by mass, one or more of,
Nb: 0.005 to 0.100%,
Cr: 0.005 to 1.00%,
V: 0.005 to 0.30%,
Cu: 0.005 to 0.30%,
Ni: 0.005 to 0.30%, and
Ca: 0.0010 to 0.0050%.

5. The hot-rolled steel sheet according to claim 4, wherein the microstructure at the location of ¼ of the sheet thickness has, an average aspect ratio of prior austenite grains of 1.0 to 4.0.

6. The hot-rolled steel sheet according to claim 1, wherein the microstructure at the location of ¼ of the sheet thickness has, an average grain size of prior austenite grains of 5 to 40 μm.

7. The hot-rolled steel sheet according to claim 6, wherein the microstructure at the location of 100 μm from the surface has, a standard deviation of Vickers hardness of 15 Hv or less.

* * * * *